US008348319B2

(12) United States Patent
LaValley et al.

(10) Patent No.: US 8,348,319 B2
(45) **Date of Patent: *Jan. 8, 2013**

(54) GRAPPLE ATTACHMENT FOR USE WITH DRILL PIPES

(75) Inventors: Roger LaValley, Bemidji, MN (US); Jason LaValley, Bemidji, MN (US)

(73) Assignee: LaValley Industries, LLC, Bemidji, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/407,043

(22) Filed: Feb. 28, 2012

(65) Prior Publication Data

US 2012/0153653 A1 Jun. 21, 2012

Related U.S. Application Data

(63) Continuation of application No. 12/201,897, filed on Aug. 29, 2008, now Pat. No. 8,146,971.

(60) Provisional application No. 61/969,418, filed on Aug. 31, 2007.

(51) Int. Cl.
*B66C 1/42* (2006.01)
*E21B 19/20* (2006.01)

(52) U.S. Cl. ..... 294/86.41; 294/81.61

(58) Field of Classification Search ..... 294/86.4, 294/86.41, 81.61, 67.5; 414/729, 732, 739; 144/4.1, 34.1, 34.5; 901/38, 39
See application file for complete search history.

(56) References Cited

U.S. PATENT DOCUMENTS

| | | | | |
|---|---|---|---|---|
| 3,231,303 | A | 1/1966 | LeTourneau | |
| 3,719,296 | A | 3/1973 | Larson, Jr. | |
| 3,727,653 | A | 4/1973 | Tucek | |
| 4,486,136 | A | 12/1984 | Howard | |
| 4,810,019 | A | 3/1989 | Brucher | |
| 4,858,979 | A | 8/1989 | Parma | |
| 5,219,265 | A | 6/1993 | Recker | |
| 5,330,242 | A * | 7/1994 | Lucky, Sr. | 294/198 |
| 5,607,251 | A | 3/1997 | Rafn | |
| 5,975,604 | A | 11/1999 | Wolin et al. | |
| 6,024,145 | A | 2/2000 | Ackles | |

(Continued)

FOREIGN PATENT DOCUMENTS

CA 2641321 4/2009

(Continued)

OTHER PUBLICATIONS

Indexator Rototilt® print outs from www.indexatornorthamerica.com/index.php, printed on Sep. 8, 2011; 10 pages.

(Continued)

*Primary Examiner* — Paul T Chin
(74) *Attorney, Agent, or Firm* — Hamre, Schumann, Mueller & Larson, P.C.

(57) ABSTRACT

A grapple attachment for use with a drill pipe having a diameter, that may include first and second gripping members disposed on a rigid lateral member tiltable up to 40 degrees from the horizontal and preferably continuously rotatable, wherein each of the first and second gripping members has a first and second claw and a bracket having a concave contact surface, each claw having a concave gripping surface, wherein the surface of the bracket and the gripping surfaces of the first and second claws come in contact with the drill pipe when the gripping member is in the closed position.

16 Claims, 7 Drawing Sheets

U.S. PATENT DOCUMENTS

| | | | | |
|---|---|---|---|---|
| 6,220,807 | B1 | 4/2001 | Sorokan | |
| 6,347,464 | B1 * | 2/2002 | Klager | 37/187 |
| 7,066,076 | B2 | 6/2006 | Roy et al. | |
| 7,357,163 | B2 | 4/2008 | Wager | |
| 2009/0057019 | A1 | 3/2009 | LaValley et al. | |
| 2010/0308609 | A1 | 12/2010 | LaValley et al. | |

FOREIGN PATENT DOCUMENTS

| | | |
|---|---|---|
| DE | 295 02 091 UI | 4/1995 |
| DE | 102 06 645 A1 | 8/2003 |
| WO | 00/53522 | 9/2000 |
| WO | 03/082725 | 10/2003 |
| WO | 2007/097698 | 8/2007 |
| WO | 2008/076067 | 6/2008 |

OTHER PUBLICATIONS

Prentice Grapples specification sheet; printed Sep. 8, 2011 from http://prenticecranes.com/prentice-grapples.html; 6 sheets.

Prentice 2410-2414 Knuckleboom Loaders; printed Sep. 8, 2011 from http://prenticecranes.com/prentice-2410-2414-knuckleboom-loaders.html; 6 sheets.

"Manipulator KM 930," Kinshofer GmbH, available at http://www.kinshofer.com/site_eng/produkte_main/main_km930.html; printed May 13, 2010; 1 page.

"Manipulator KM 930," Kinshofer Gmbh, available at http://www.kinshofer.com/site_eng/produkte_main/Resources/KM_930_eng.pdf ; printed May 13, 2010; 1 page.

"Selling GB Wood Grapple products," GB Industries Co. Ltd, available at http://kennycho.trustpass.alibaba.com/product/107764499-11334694/Selling_GB_Wood_Grapple_products.html ; printed May 13, 2010; 3 pages.

"Selector/Demolition Grabs," McQuaid Engineering Ltd, available at http://www.alibaba.com/product/mcquaid84-215959236-0/Selector_Demolition-Grabs.html ; printed May 13, 2010; 3 pages.

"Kinshofer Manipulators—Kinshofer-KM930," available at http://www.worktruck-outfitters.com/kinshofer-manipulators-p-1281.html ; printed May 13, 2010; 4 pages.

Drawings and Photographs of a Grapple manufactured by Weldco Beales Mfg.; in Applicants possession on or about Mar. 20, 2010; 15 pages.

Pictures of a grapple mechanism printed from http://rotobec.com/web/2610_PH_Pipe_and_Pole-Handler.html and http://rotobec.com/resources/images/products/rotations/RGP-252_main.jpg on Mar. 30, 2010, but possibly posted on the Internet as early as Sep. 2009; 2 pages.

Five photographs taken in Jan. 2010 of a grapple mechanism used by Michels Corporation.

Drawings of Heavy Duty Pole Claw manufactured by EZ-Spot-UR, dated Apr. 29, 2010, found online at http://www.ezspotur.com/HDPC-01-0006_NO_SETBACK.pdf (1 page).

* cited by examiner

GRAPPLE ATTACHMENT FOR USE WITH DRILL PIPES

RELATED APPLICATIONS

This application is a continuation application of U.S. application Ser. No. 12/201,897 filed on Aug. 29, 2008, now U.S. Pat. No. 8,146,971, which claims priority to U.S. Provisional Application No. 60/969,418, filed Aug. 31, 2007.

FIELD

The present invention pertains to a grapple for grasping and manipulating drill pipes used with a directional drilling rig that can be attached to a trackhoe, backhoe, excavator or other piece of heavy construction equipment.

BACKGROUND

Utility lines for gas, water, electricity and data are frequently buried underground. An increasing popular method of installing these lines is to drill a hole using a horizontal directional drilling technique. This technique allows the hole to pass under existing structures such as roads or sewers and existing geographical features such as rivers without disturbing them. A typical horizontal directional drilling rig includes a frame on which is mounted a drive mechanism that can be slidably moved along the frame and which is adapted to rotate a drill string. Sliding the drive mechanism while rotating the drill string advances the drill string into the ground to create a hole. The drill string includes a drill head and a series of drill pipes. As the hole is lengthened, the drill string needs to be lengthened to permit the drill head to dig further through the ground. This is done by successively attaching drill pipes to the drill string as the drill is advanced into the ground. The hole is typically started at an oblique angle to the ground. When a desired depth is reached the drill head is directed to advance the hole in a substantially horizontal direction. Towards the end of the hole, the drill head is usually directed upwards at an angle until the drill string breaks through the surface. When the hole has been bored, this operation is reversed and drill pipes are successively removed from the drill string to shorten the drill string as it is retracted.

In a typical operation, the drill pipes are 32 feet long, have a 6 and ⅝ inch diameter and weigh approximately 1325 pounds. The drill pipes are hauled to the drilling site by truck and each pipe is individually lifted from the bed of the truck to attach it manually to the drill string. This operation is typically carried out by an excavator. A manual calipers, attached to the bucket of the excavator by a cable or nylon strap, is secured around a drill pipe. Balancing the drill pipe in the calipers, an operator uses the excavator to lift the drill pipe to the drill rig. Two or more workers steady and guide the drill pipe as it is moved into location by the excavator operator. At the drill rig, the workers manually tilt and rotate the pipe into position. In a typical operation, a drill pipe may be held horizontal or may be tilted about 12 degrees. A drill pipe is typically not tilted more than 35 degrees. Once the drill pipe is positioned as desired by the works and the excavator operator, the drill pipe is manually secured to the drill string. This is a cumbersome and dangerous operation which requires three or more workers (e.g., the one operating the excavator and at least two on the ground). There is thus a need for a device which improves safety and ease of use while reducing manpower.

SUMMARY

One embodiment of the invention pertains to a grapple attachment for an excavator or other suitable piece of heavy machinery. The grapple attachment includes a bracket for attachment to the bucket attachment on an excavator, a swivel assembly to permit the main body of the grapple attachment to rotate in either direction and a main body pivotably connected to the swivel assembly at a pivot point and with a hydraulic arm that permits the main body to be angled at up to 35 degrees. The main body includes a pair of gripping members spaced apart on a rigid lateral member. Each gripping member includes a first and second claw. The gripping member may include a bracket having a curved contact surface and each of the claws may include a curved gripping surface such that the gripping surface of the claws and the contact surface are in contact with the drill pipe when grabbing the drill pipe. The grapple attachment can be used to easily and efficiently move and angle the drill pipe into position for attachment to the drill string with total control by the excavator operator without the need for assistance and manipulation by other workers.

Another embodiment of the invention pertains to a grapple attachment that includes a bracket for attachment to a piece of heavy machinery, a swivel assembly to permit the main body of the grapple attachment to rotate in either direction and a main body pivotably connected to the swivel assembly so that the main body can be pivoted using hydraulics or other means with respect to the swivel assembly. A pair of gripping members may be slidably disposed on the main body so that the pair of gripping members may be slid back and forth on the main body to provide a further positioning aid.

The above summary of some example embodiments is not intended to describe each disclosed embodiment or every implementation of the invention.

BRIEF DESCRIPTION OF THE DRAWINGS

The invention may be more completely understood in consideration of the following detailed description of various embodiments in connection with the accompanying drawings, in which.

Figure 1:
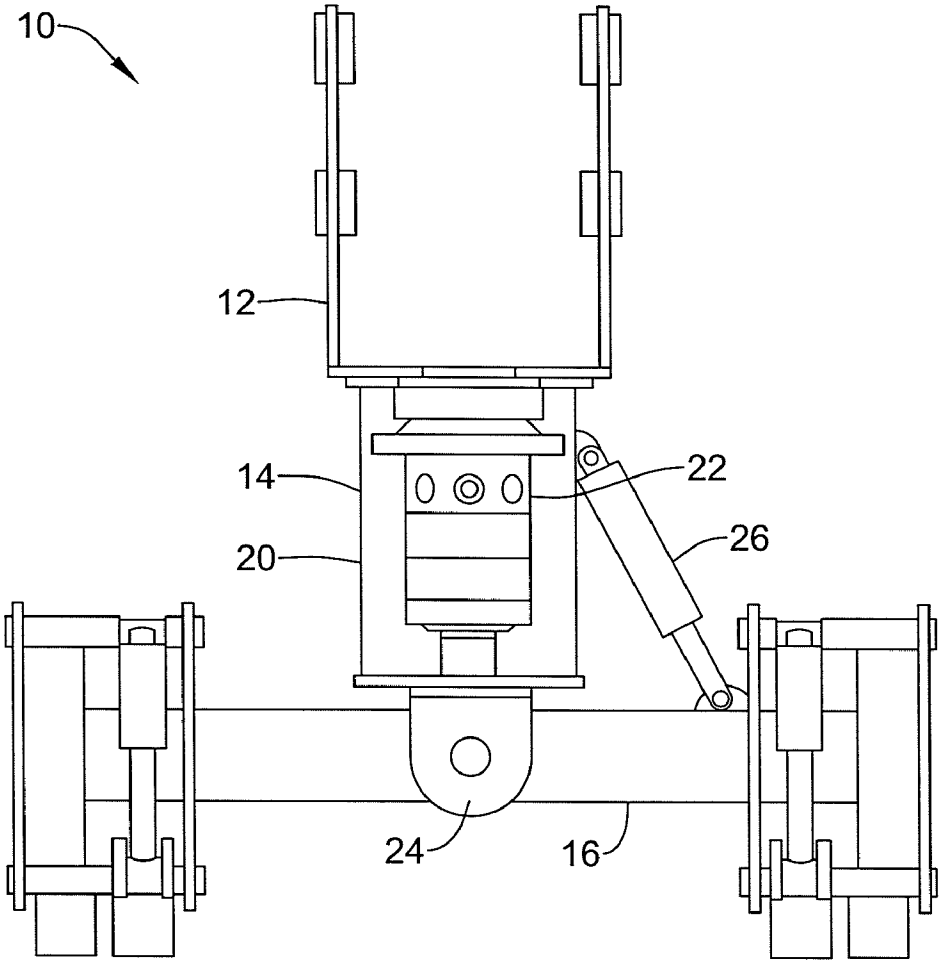
FIG. 1 is a diagrammatic plan view of a grapple attachment according to the invention.

While the invention is amenable to various modifications and alternative forms, specifics thereof have been shown by way of example in the drawings and will be described in detail. It should be understood, however, that the intention is not to limit aspects of the invention to the particular embodiments described. On the contrary, the intention is to cover all modifications, equivalents, and alternatives falling within the spirit and scope of the invention.

DETAILED DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimensions ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The detailed description and the drawings, which are not necessarily to scale, depict illustrative embodiments and are not intended to limit the scope of the invention. The illustrative embodiments depicted are intended only as exemplary. Selected features of any illustrative embodiment may be incorporated into an additional embodiment unless clearly stated to the contrary.

Figure 2:
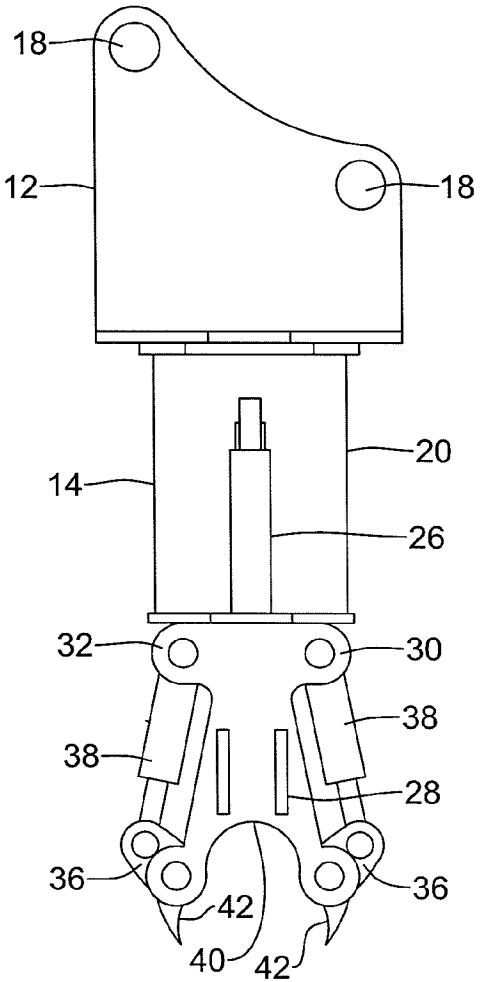
FIG. 2 is a diagrammatic side view of the grapple attachment of FIG. 1.
Figure 3:
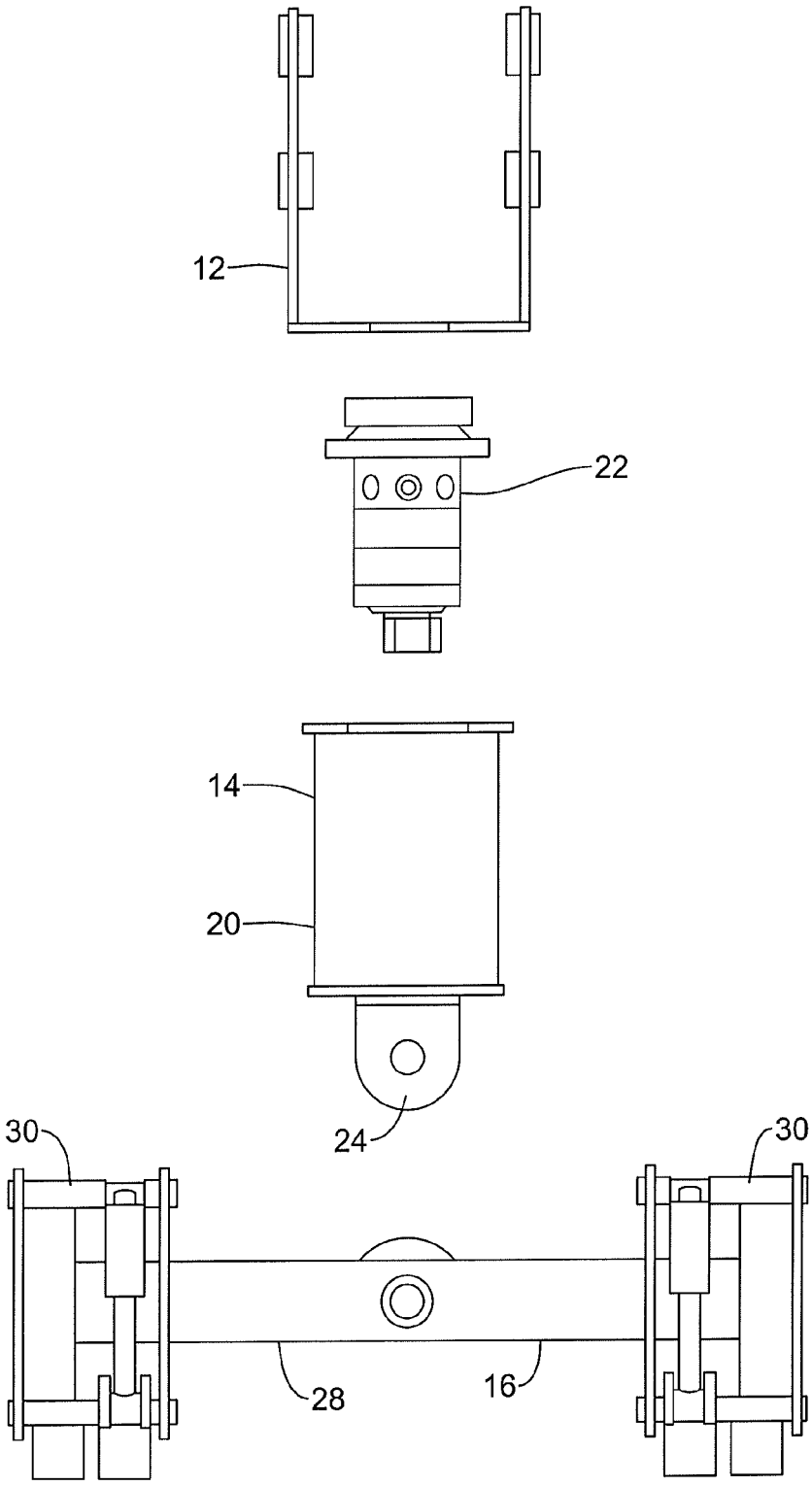
FIG. 3 is an diagrammatic exploded plan view of the grapple attachment of FIG. 1.

A grapple attachment 10 in accordance with the invention is depicted in diagrammatic fashion in plan view in FIG. 1, in side view in FIG. 2 and in an exploded plan view in FIG. 3. The grapple attachment includes a bracket attachment 12, a swivel assembly 14 and a main body 16.

The terms horizontal, vertical, lateral and like terms are used herein with respect to the grapple attachment as depicted in FIG. 1. Thus horizontal and lateral are the left and right of FIG. 1 and vertical is the up and down of FIG. 1. For example, the main body 16 may be said to extend in predominately a lateral direction. This usage of the terminology should not be interpreted to mean that the components so described must always be as described in an absolute sense. The grapple attachment attaches to a hydraulic arm of a piece of heavy equipment and it is possible, for example, to manipulate the grapple attachment so that the main body 16 is predominately vertical in an absolute sense. However, for the purposes of this discussion, the vertical direction extends through the bracket attachment, the swivel assembly and the main body and the horizontal direction is perpendicular thereto.

The grapple attachment is hooked up to an excavator or other piece of heavy equipment. The term excavator is used throughout this description for the sake of simplicity but other pieces of heavy equipment may be suitable for use with a grapple attachment according to the invention. For example, the grapple attachment may be used with a trackhoe, backhoe or any other piece of equipment having a suitable arm.

The bracket attachment 12 includes holes 18 to provide a mechanical interface with a boom arm. The bracket is thus rigidly connected to the end of the stick arm with no degrees of freedom. The bracket attachment as shown is suitable for attachment to a standard stick arm. Any bracket suitable for rigid attachment to a stick arm is within the scope of the invention. The bracket attachment may also include pins sized to span the width of the bracket and fit within holes 18. The size and position of holes 18 may be varied as desired to adapt the bracket to a specific excavator model.

The swivel assembly 14 includes a swivel assembly housing 20 and a hydraulic rotation control 22. The rotation control 22 is disposed in the center of the housing 20 and is rigidly connected thereto with bolts or other suitable fastener. One end of the rotary control is attached to the bracket attachment 12 with bolts or other suitable fasteners. The rotation control 22 can be operated to rotate the swivel assembly 14 with respect to the bracket attachment about a vertical axis. The rotation control preferably includes a hollow center throat (not shown) extending through the device along a vertical axis to permit hydraulic lines or other conduits to be routed through the center of the hydraulic rotation control 22. Swivel assembly housing 20 includes a housing 22 for receiving the hydraulic rotation control and a bottom bracket 24 for pivotably connecting the swivel assembly to the main body 16.

In one alternative embodiment, the grapple attachment may include a "parking brake" (not shown) mounted between the swivel assembly and the bracket attachment. The parking brake may include a ring mounted on the swivel assembly and a spring loaded hydraulic caliper mounted on the bracket assembly. Such a feature would prevent rotational creep between the bracket attachment and the swivel assembly when the grapple attachment is not in use. Of course, other devices are contemplated which may provide a similar feature. For example the parking brake may be electrically powered rather than hydraulically or may be manually activated or deactivated with a lever, for example. Other alternatives such a manually activated latch system extending between the bracket attachment and the swivel assembly are also contemplated.

The main body 16 is pivotably connected to the bottom bracket 24 of the swivel assembly and is also connected to the swivel assembly by a tilt arm 26 disposed to one side of the swivel assembly 14. The pivot connection includes a central pin, a bushing such as a rubber bushing or a steel bushing and/or other elements suitable to a load bearing pivot connection of this type. The tilt arm 26 is pivotably connected to both the swivel assembly housing 20 and the main body and is preferably a hydraulic arm. Both connections acting together ensure that the main body can pivot about a horizontal axis up to a maximum of about 30 degrees from the horizontal. In some embodiments that maximum is 40 degrees from the horizontal; in other embodiment that maximum is 25 degrees from the horizontal.

Figure 4:
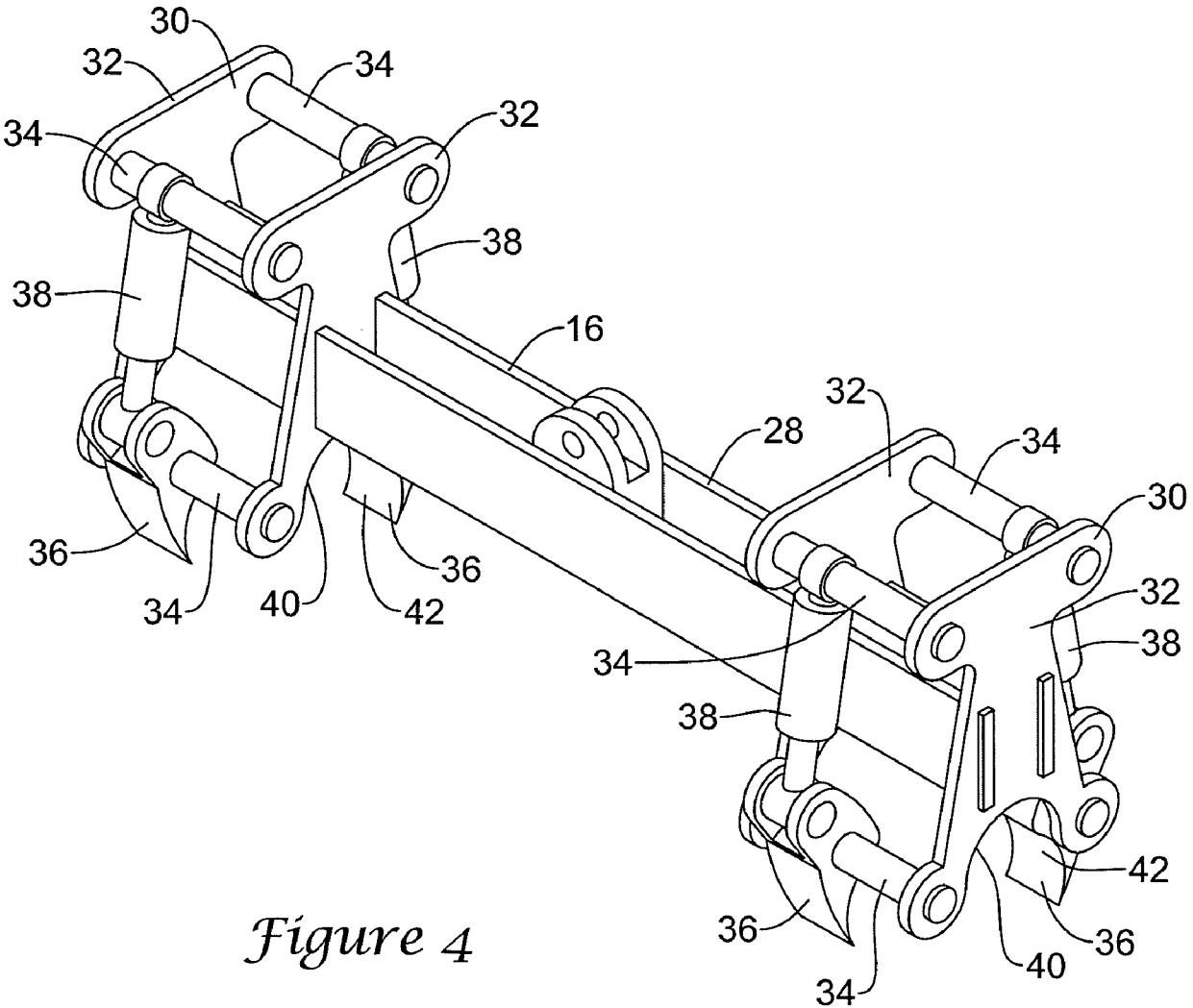
FIG. 4 is a diagrammatic orthogonal view of a main body 16 portion of a grapple attachment.

The main body includes a rigid lateral member 28 that has first and second gripping members 30 disposed thereon. Each gripping member 30 may include a first and second bracket 32 spaced apart by rods 34 and a first and second claw 36. Each claw has a first hole for mounting the claw on and rotating the claw about a rod 34 and a bracket for mounting to one end of a hydraulic piston 38. The other end of the hydraulic piston is mounted on another rod 34. The hydraulic piston serves to actuate the claw between an open position and a closed position. The first and second claw of each gripping member may be spaced laterally apart from each other as shown in FIG. 4 or may line up to open and close in the same plane. Preferably, each bracket has a concave contact surface 40 that has a radius equal to half the diameter of a drill pipe. A typical embodiment is built for use with a drill pipe having a nominal 6 and ⅝ inch outer diameter. Alternatively, the concave contact surface may have a radius that is slightly larger than half the diameter of a drill pipe. Preferably, each claw has a curved gripping surface (indicated at 42) that also has a radius that is half the diameter of a drill pipe. Each gripping member may be configured so that the bracket contact surface 40 and gripping surfaces 42 of first and second claws 36 come in contact with the drill pipe when closed over the drill pipe. Preferably, and as depicted in FIG. 2, each claw 36 has a profile that rapidly tapers towards a free end. As the free end of the claw pictured has a convex side (the gripping surface 40) and a concave side, the claw free end may be described as having a profile like that of the end of a crescent moon. Of course, other tapering profiles are contemplated. For example, a claw having a snub nose profile may be suitable for use with some embodiments of the invention.

The gripping members are configured so that they open and close simultaneously. When open, the gripping surfaces of the claws preferably extend no more than the diameter of a drill pipe from a central vertical plane extending through the width of the main body. For example, for a typical embodiment built for use with a drill pipe of 6 and ⅝ inch diameter, each claw may extend no more than 6 inches or no more than 5 and ½ inches from the central vertical plane of the main body. In such a case the maximum distance between the free ends of first and second claws of a gripping member, when looking at an end view of the gripping member as in FIG. 2, is 12 or 11 inches, respectively. This limit on the maximum expansion of the gripping member may be made by selection and design of the parts of the gripping member such that it is physically impossible to further expand the claws of the gripping member or may be done through electronic controls and software.

Of course, other embodiment are contemplated which are adapted for pipes of other diameters. Other standard drill pipe diameters are (all in inches) 2⅜, ⅞, 3½, 4, 4½, 5½, 6⅝, 7⅝ and 8⅝. The gripping members including the claws and the brackets may be particular adapted for one or more of these standard drill pipe sizes or with a pipe of a different diameter in mind.

The hydraulic rotation control 22, the hydraulic arm 26 and the hydraulic pistons 38 require a hydraulic power source. In a preferred embodiment, the grapple attachment 10 also includes a hydraulic manifold (not shown). Hydraulic power lines, electrical power lines and control lines are connected to the manifold and hydraulic power is sent through the manifold as desired to operate the hydraulic accessories. The hydraulic power lines may be routed through the throat of the hydraulic rotation control to keep them inside the grapple attachment and protect them during operation.

A grapple attachment according to the invention may also include control members which can be attached to the control panel of the cab of the excavator using conventional methods.

Figure 5:
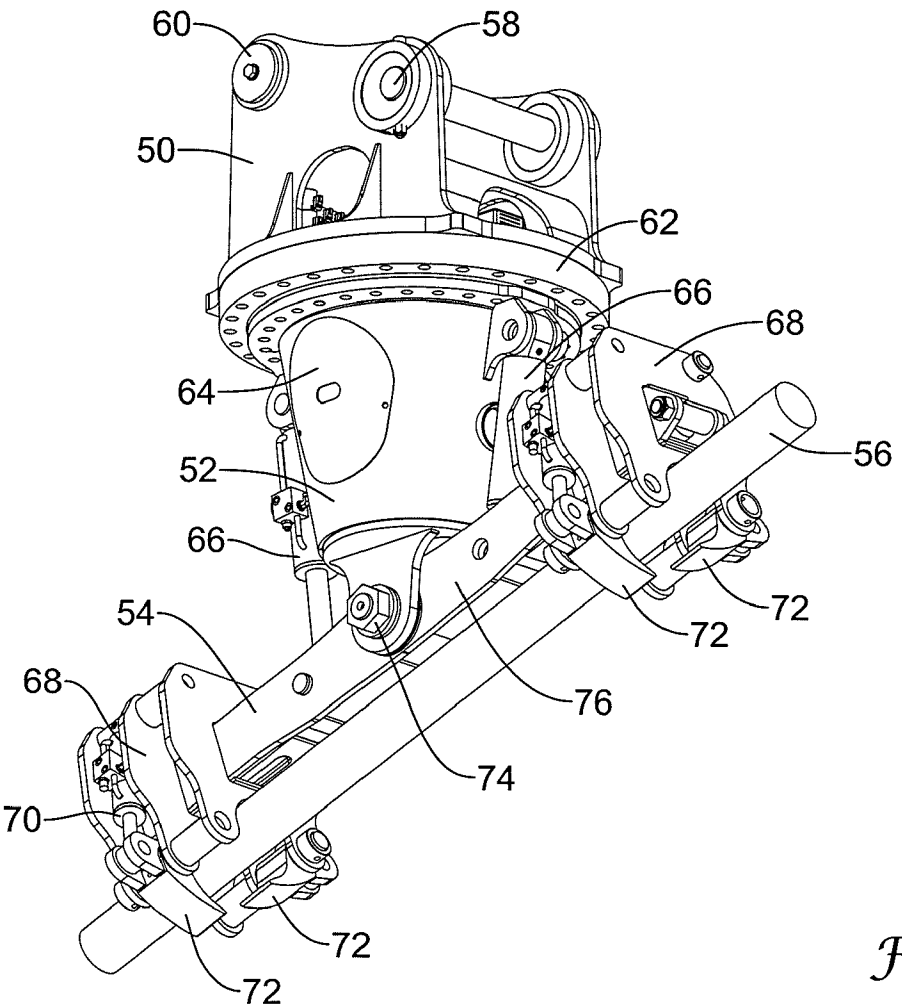
FIG. 5 is a diagrammatic orthogonal view of a grapple attachment.
Figure 6:
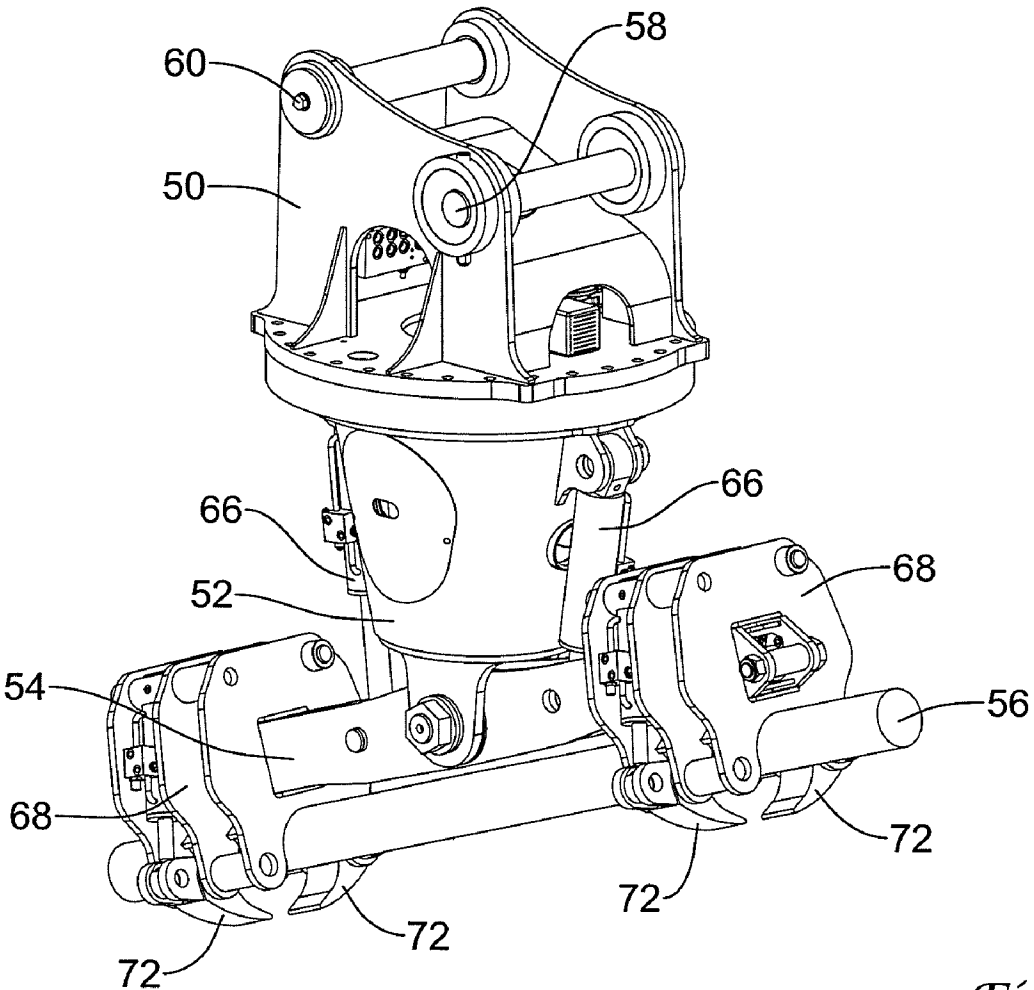
FIG. 6 is a diagrammatic orthogonal view of the grapple attachment of FIG. 5.

Another embodiment is illustrated by orthographic projection in FIG. 5. This embodiment includes, generally, an attachment bracket 50, a main housing 52 and a main beam 54. The attachment bracket is adjustable to fit a variety of sizes of boom arm fittings. Pins 58 and 60 may be 80 mm to 90 mm in diameter and may be replaced with pins of a different diameter as desired. Pin 58 is offset in its fixture and may be rotated to adjust the distance between the two pins to provide flexibility in attaching to various boom arms.

The attachment bracket 50 may be attached to the main housing 52 by a slewing ring 62, which allows free rotation of the main housing with respect to the attachment bracket. The slewing ring includes an outer ring fixed to the attachment bracket and an inner ring fixed to the main housing. Each of the outer and inner rings includes a bearing race to confine a set of bearings to permit the rotation. In one contemplated embodiment, a hydraulic motor disposed in the attachment bracket is connected to a shaft by a pinion to control the rotation of the main housing. Of course, any suitable mechanism may be used to rotate the main housing with respect to the attachment bracket. Also disposed between the main housing and the attachment bracket is a swiveling hydraulic connector to allow hydraulic power to be passed though the slewing ring without impeding the rotational movement of the connection.

The main housing includes an access door 64 to allow access to the hydraulic lines contained within. The main housing is attached to the main beam 54 with a pivoting joint 74. The pivoting joint 74 may be a pin with bushings or other appropriate mechanism to allow a pivoting movement. One or preferably two hydraulic arms 66 may connected between the main housing and the main beam to hydraulically control the relative positions of the main beam and the main housing.

The main beam 54 includes a generally tubular beam 76 with a pair of claws 68 disposed on the ends of the tubular beam. The pair of claws 68 are slidably disposed on the tubular beam 76 so that the pair can be slid back and forth. The contemplated range of motion of each claw may be 4, 5, 6, 7, 8, 9, 10, 11 or 12 inches. In one preferred embodiment, the claws 68 slide back and forth as one so that the distance between the claws remains constant.

Figure 7:
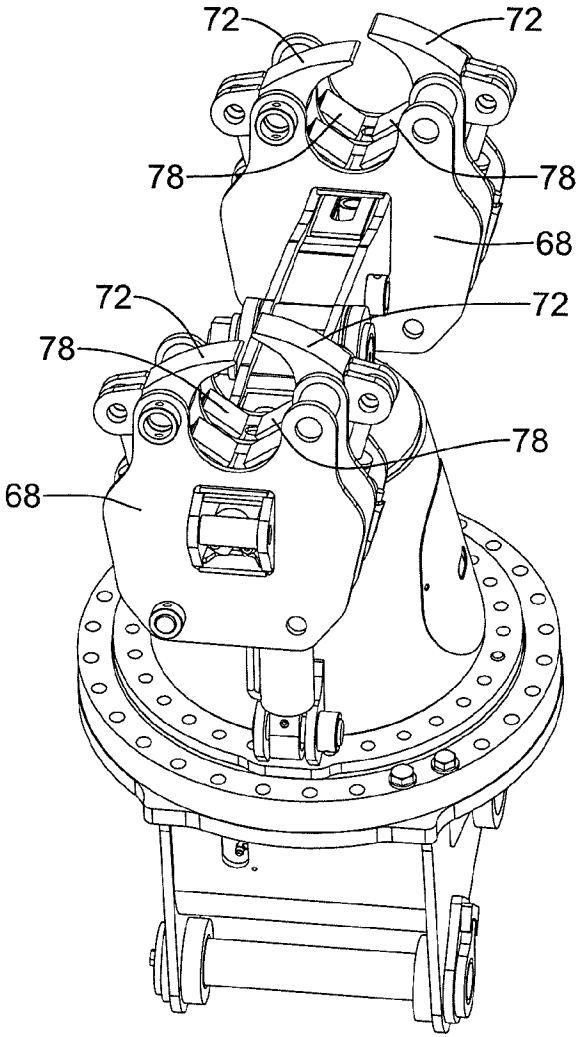
FIG. 7 is another diagrammatic orthogonal view of the grapple attachment of FIG. 5.

Each claw includes an arm housing, which is disposed over the tubular beam 76, and arms 72, which are actuated by hydraulics 70 to grab a drill pipe 56. As can be best seen in FIG. 7, the claws may also include pads 78, arranged in a "V", to help secure a drill pipe in place once grabbed by the arms. The pads 78 are somewhat resilient to help the drill pipe resist lateral and rotational movement once clamped.

This embodiment allows positioning of the drill pipe by moving the boom arm of the piece of heavy equipment, by rotation of the main housing, by pivoting of the main beam, and by sliding the claws on the main beam.

An embodiment may also include a horn and lights. In some pieces of heavy equipment, the horn and lights may be disconnected to allow attachment of this grapple attachment. Putting a horn and lights on the attachment restores this functionality.

In contemplated alternative embodiments, the rotation control, tilt arm and claws need not be hydraulically operated. For example, in one contemplated embodiment the rotation control is an electric motor or may be an electrically powered ring gear mechanism. Further, power may be transmitted through the rotation control using brushes so that the main body can be rotated continuously with respect to the bracket attachment. The tilt arm may be a hydraulic arm, a screw-type actuator or other actuator suitable for the purpose. In one alternative embodiment, the tilt arm is replaced by an electric motor disposed at the pivot point. Likewise, in some alternative embodiments, the claws may be actuated using a screw-type actuator, a cam shaft or other suitable system. It can thus be seen that the invention is not limited to hydraulically powered embodiments.

In use, an excavator operator can unhook a bucket from a boom arm using a control on the control panel and can then maneuver the free end of the boom arm over to a grapple attachment and mechanically connect the grapple attachment to the boom arm from within the excavator cab. Next, someone makes the hydraulic and electrical connections between the grapple attachment and the accessory lines of the excavator and the controls are installed in the excavator control panel to complete the set-up process.

The excavator operator can manipulate the grapple attachment by bending and moving the stick of the excavator and can also operate the hydraulic rotation control, tilt arm and gripping members of the grapple attachment. Operation of the hydraulic rotation control causes the swivel assembly and the main body to rotate in a horizontal plane. Preferably, the swivel assembly and main body can rotate continuously in either direction. Operation of the tilt arm causes the main body to rotate out of the horizontal plane. In some embodiments, the main body can rotate out of the horizontal plane up to 35 degrees, 30 degrees or 25 degrees. Operation of the gripping members causes the claws to open and close.

Once the grapple attachment is installed on the excavator, it can be used to move drill pipes. A drill pipe can be grabbed using the grapple attachment and moved to the drilling rig. The grapple attachment is configured to aid the operator in gripping a pipe. The maximum width between the claws prevents the gripping members from spanning the top of more than one pipe. As the gripping members are lowered, the profile of the claws guides the claws down the curved outer surfaces between two pipes and the narrow free ends of the claws permit the claws to more easily fit between adjacent pipes. Once the claws are past the center line of the pipe, the operative may climb the pipe up into the grapple attachment. Alternatively, the operator may fully lower the grapple attachment down onto the pipe. The drill pipe is then moved over to the drill rig and angled into place to be attached to the drill string. The operation can be easily repeated and can be easily reversed when withdrawing and disassembling the drill string.

It will thus be appreciated that a grapple attachment according to the invention can be used to pick up and manipulate a heavy and bulky drill pipe easily and efficiently to any position required with a horizontal directional drilling rig.

Those skilled in the art will recognize that the present invention may be manifested in a variety of forms other than the specific embodiments described and contemplated herein. Accordingly, departure in form and detail may be made without departing from the scope and spirit of the present invention as described in the appended claims.

What is claimed is:

1. A grapple attachment, comprising:

an attachment bracket;

a swivel assembly rotatably connected to the attachment bracket to permit rotation of the swivel assembly relative to the attachment bracket about a swivel axis;

a motor connected to the swivel assembly to rotate the swivel assembly about the swivel axis;

an elongated main beam pivotally connected to the swivel assembly so that the elongated main beam can pivot relative to the swivel housing about a pivot axis that is perpendicular to the swivel axis, the elongated main beam has an axis that is perpendicular to the pivot axis and to the swivel axis, and the elongated main beam is rotatable with the swivel housing about the swivel axis;

the swivel assembly is positioned between the attachment bracket and the elongated main beam;

a first actuator connected to the main beam to tilt the main beam about the pivot axis, the first actuator having a first end attached to the swivel assembly and a second end attached to the main beam;

a second actuator connected to the main beam to tilt the main beam about the pivot axis, the second actuator having a first end attached to the swivel assembly and a second end attached to the main beam for tilting the main beam about the pivot axis; and the second end of the first actuator and the second end of the second actuator are positioned on opposite sides of the pivot axis.

2. The grapple attachment of claim 1, further comprising first and second gripping members mounted on the main beam, the first and second gripping members each include an arm housing, first and second cooperating arms mounted on each of the arm housings, and arm actuators connected to the arms for actuating the arms between an open position and a closed position.

3. The grapple attachment of claim 2, wherein the first and second gripping members are slideably disposed on the main beam to permit adjustment of the positions of the first and second gripping members on the main beam in directions parallel to the axis of the main beam.

4. The grapple attachment of claim 3, wherein each gripping member is adjustable on the main beam between 4-12 inches.

5. The grapple attachment of claim 1, wherein the swivel assembly can rotate continuously about the swivel axis.

6. The grapple attachment of claim 1, wherein the main beam can pivot relative to the swivel housing about the pivot axis a maximum of 40 degrees.

7. The grapple attachment of claim 1, wherein the motor is a hydraulic motor or an electric motor.

8. The grapple attachment of claim 1, wherein the swivel assembly includes a housing, and the first end of the first actuator and the first end of the second actuator are attached to an outside surface of the housing.

9. A grapple attachment, comprising:

an attachment bracket that is configured to connect the grapple attachment to construction equipment via a pair of attachment pins;

a swivel assembly rotatably connected to the attachment bracket to permit rotation of the swivel assembly relative to the attachment bracket about a swivel axis;

a motor connected to the swivel assembly to rotate the swivel assembly about the swivel axis;

an elongated main beam pivotally connected to the swivel assembly so that the elongated main beam can pivot relative to the swivel housing about a pivot axis that is perpendicular to the swivel axis, the elongated main beam has an axis that is perpendicular to the pivot axis and to the swivel axis, and the elongated main beam is rotatable with the swivel housing about the swivel axis;

the swivel assembly is positioned between the attachment bracket and the elongated main beam;

a first actuator connected to the main beam to tilt the main beam about the pivot axis, the first actuator having a first end attached to the swivel assembly and a second end attached to the main beam;

a second actuator connected to the main beam to tilt the main beam about the pivot axis, the second actuator having a first end attached to the swivel assembly and a second end attached to the main beam for tilting the main beam about the pivot axis;

the second end of the first actuator and the second end of the second actuator are positioned on opposite sides of the pivot axis; and first and second gripping members mounted on the main beam, the first gripping member being disposed on one side of the pivot axis and the second gripping member being disposed on a second side of the pivot axis.

10. The grapple attachment of claim 9, wherein the first and second gripping members each include:

an arm housing having a contact surface that is configured to contact an object gripped by the respective gripping member during use;

first and second arms mounted on each arm housing with the first and the second arms including gripping surfaces that contact an object gripped by the respective gripping member during use; and arm actuators mounted on each arm housing and connected to the first and second arms for actuating the arms between open and closed positions;

wherein the contact surface of each arm housing and the gripping surfaces of the first and second arms of each arm housing contact an object being gripped by the respective gripping member when the first and second arms are in the closed position.

11. The grapple attachment of claim 9, wherein the first and second gripping members are slideably disposed on the main beam to permit adjustment of the positions of the first and second gripping members on the main beam in directions parallel to the axis of the main beam.

12. The grapple attachment of claim 11, wherein each gripping member is adjustable on the main beam between 4-12 inches.

13. The grapple attachment of claim 9, wherein the swivel assembly can rotate continuously about the swivel axis.

14. The grapple attachment of claim 9, wherein the main beam can pivot relative to the swivel housing about the pivot axis a maximum of 40 degrees.

15. The grapple attachment of claim 9, wherein the motor is a hydraulic motor or an electric motor.

16. The grapple attachment of claim 9, wherein the swivel assembly includes a housing, and the first end of the first actuator and the first end of the second actuator are attached to an outside surface of the housing.

* * * * *